US007245869B2

(12) United States Patent
Kim et al.

(10) Patent No.: US 7,245,869 B2
(45) Date of Patent: Jul. 17, 2007

(54) PAPER SUPPLY UNIT AND AN IMAGE FORMING APPARATUS HAVING THE SAME

(75) Inventors: Young-min Kim, Suwon-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/280,733

(22) Filed: Nov. 17, 2005

(65) Prior Publication Data

US 2006/0263127 A1 Nov. 23, 2006

(30) Foreign Application Priority Data

May 20, 2005 (KR) ..... 10-2005-0042294

(51) Int. Cl.
*B41J 29/00* (2006.01)
*B65H 1/04* (2006.01)

(52) U.S. Cl. ..... 399/377; 399/393; 400/624; 400/691

(58) Field of Classification Search ..... 399/98, 399/367, 377, 380, 388, 381, 393, 124; 400/713, 400/691; 271/145, 162; 347/104, 108
See application file for complete search history.

(56) References Cited

U.S. PATENT DOCUMENTS 4,204,668 A * 5/1980 Yanagawa ..... 271/9.02
5,222,722 A * 6/1993 Kamano ..... 271/9.09
5,711,517 A * 1/1998 Kelly ..... 271/4.01
6,053,493 A * 4/2000 Yokoyama et al. ..... 271/171
6,435,745 B1 * 8/2002 Yamada ..... 400/624
6,474,884 B2 * 11/2002 Chiu ..... 400/624

(Continued)

FOREIGN PATENT DOCUMENTS

JP 06-144598 5/1994

(Continued)

*Primary Examiner*—Matthew Luu
*Assistant Examiner*—Joshua M Dubnow
(74) *Attorney, Agent, or Firm*—Stein, McEwen & Bui, LLP

(57) ABSTRACT

A paper supply unit including a front cover mounted to a main body of the image forming apparatus to occupy and move between open and closed positions, and, when occupying the opened position, defining a paper receiving space in which printing paper is to be stacked, and a tray cover, disposed to cover the printing paper stacked on the front cover to prevent an inflow of dust or foreign substances, to be inserted into and drawn out of the main body of the image forming apparatus. An image forming apparatus including a main body including a print engine part and a paper supply port, a front cover mounted to a main body of the image forming apparatus to occupy and move between open and closed positions, and, when occupying the opened position, defining a paper receiving space in which printing paper is to be stacked, a tray cover, disposed to cover the printing paper stacked on the front cover to prevent an inflow of dust or foreign substances, to be inserted into and drawn out of the main body of the image forming apparatus and a sliding unit to guide an entrance of the tray cover into the main body and an exit of the tray cover from respect to the main body.

16 Claims, 5 Drawing Sheets

U.S. PATENT DOCUMENTS

| | | | | |
|---|---|---|---|---|
| 6,890,071 | B2 * | 5/2005 | Khormaei et al. | 347/104 |
| 6,991,331 | B2 * | 1/2006 | Kagami et al. | 347/108 |
| 2002/0061206 | A1 * | 5/2002 | Enomoto et al. | 399/124 |
| 2002/0164190 | A1 * | 11/2002 | Hill | 400/624 |
| 2004/0169327 | A1 * | 9/2004 | Swayze et al. | 271/145 |
| 2005/0201792 | A1 * | 9/2005 | Park et al. | 399/393 |
| 2005/0225025 | A1 * | 10/2005 | Chikumoto | 271/162 |
| 2006/0056901 | A1 * | 3/2006 | Shiraishi et al. | 400/625 |
| 2006/0083566 | A1 * | 4/2006 | Hwang | 399/391 |
| 2006/0222436 | A1 * | 10/2006 | Bandou et al. | 400/691 |

FOREIGN PATENT DOCUMENTS

| | | | |
|---|---|---|---|
| JP | 2003-192152 | | 7/2003 |
| KR | 1993-11661 | B1 | 12/1993 |
| KR | 2005-20267 | A | 3/2005 |

* cited by examiner

PAPER SUPPLY UNIT AND AN IMAGE FORMING APPARATUS HAVING THE SAME

CROSS-REFERENCE TO RELATED APPLICATIONS

This application claims the benefit of Korean Application No. 2005-42294, filed May 20, 2005, in the Korean Intellectual Property Office, the disclosure of which is incorporated herein by reference.

BACKGROUND OF THE INVENTION

1. Field of the Invention

An aspect of the present invention relates to an image forming apparatus such as printer, copier, and multi-operation apparatus. More particularly, an aspect of the present invention relates to a structurally improved paper supply unit and an image forming apparatus having the same installed therein.

2. Description of the Related Art

Image forming apparatuses generally include a paper supply unit, in which a plurality of paper sheets is stacked, to supply the paper sheets to an engine unit. The paper supply unit may be a cassette type, which is detachably mounted to a main body of the image forming apparatus, and a tray type, which is opened and closed in a pivoting manner with respect to the main body of the image forming apparatus.

The tray-type paper supply unit is usually adopted in a small-size image forming apparatus. FIGS. 1 and 2 show an example of the tray-type paper supply unit.

Referring to FIGS. 1 and 2, an image forming apparatus 10 comprises a front cover 11 to allow an opening and closing of a front thereof. As shown in FIG. 2, a plurality of paper sheets may be stacked in the front cover 11 when the front cover 11 is opened. Also, a rear-end guide 12 is slidably mounted to the front cover 11 to arrange rear ends of the paper sheets. A tray cover 13 is detachably mounted above the front cover 11 to prevent the stacked paper from being contaminated by dust or foreign substances.

The tray cover 13 is to be disposed over the front cover 11 when the image forming apparatus 10 is in use. However, when the image forming apparatus 10 is not in use or is being stored, the tray cover 13 may be detached, as shown in FIG. 2, to be separately stored. In this case, the tray cover 13 could be lost and, as a result, when the image forming apparatus 10 is used without the tray cover 13 mounted, dust or foreign substances may flow in and generate a malfunction of the image forming apparatus 10.

SUMMARY OF THE INVENTION

An aspect of the present invention is to solve at least the above problems and/or disadvantages and to provide at least the advantages described below. Accordingly, an aspect of the present invention provides a paper supply unit having an improved structure so as to prevent a loss of parts and a breakdown of an image forming apparatus as a result of an inflow of foreign substances, and an image forming apparatus having the same installed therein.

In order to achieve the above-described aspects of the present invention, there is provided a paper supply unit comprising a front cover mounted to a main body of the image forming apparatus to pivot in an opening and closing manner and when being opened, operating as a paper receiving space for stacking printing paper thereon, and a tray cover disposed to cover the printing paper stacked on the front cover to prevent inflow of dust or foreign substances and inserted and drawn out with respect to the main body of the image forming apparatus.

The paper supply unit may further comprise a sliding unit which guides entrance and exit of the tray cover with respect to the main body. The sliding unit comprises guide rails mounted on opposite sidewalls inside of the main body, respectively; and projections formed on opposite sides of the tray cover, respectively, and received in the guide rail. The tray cover, as drawn out from the main body, is pivoted upward about the projections. The paper supply unit may further comprise a rear-end guide movably mounted to the front cover to arrange a rear end of the paper being stacked. The rear-end guide and the tray cover are moved together.

According to another aspect of the present invention, there is provided an image forming apparatus comprising a main body including a print engine part and a paper supply port, a front cover mounted to the paper supply port of the main body to pivot in an opening and closing manner and when being opened, operating as a paper receiving space for stacking printing paper thereon, a tray cover disposed to cover the printing paper stacked on the front cover to prevent inflow of dust or foreign substances and inserted and drawn out with respect to the main body of the image forming apparatus, and a sliding unit guiding entrance and exit of the tray cover with respect to the main body.

The other structures regarding the front cover, the tray cover and the sliding unit are the same as described for the paper supply unit.

According to the embodiments of the present invention as aforementioned, since the tray cover is stored inside the image forming apparatus when the image forming apparatus is not in use, loss of the tray cover can be prevented. In addition, when the image forming apparatus is used, the tray cover slides out together with the rear-end guide to cover the upper part of the paper supply unit, thereby preventing inflow of dust or foreign substances into the paper supply unit where the paper is stacked.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
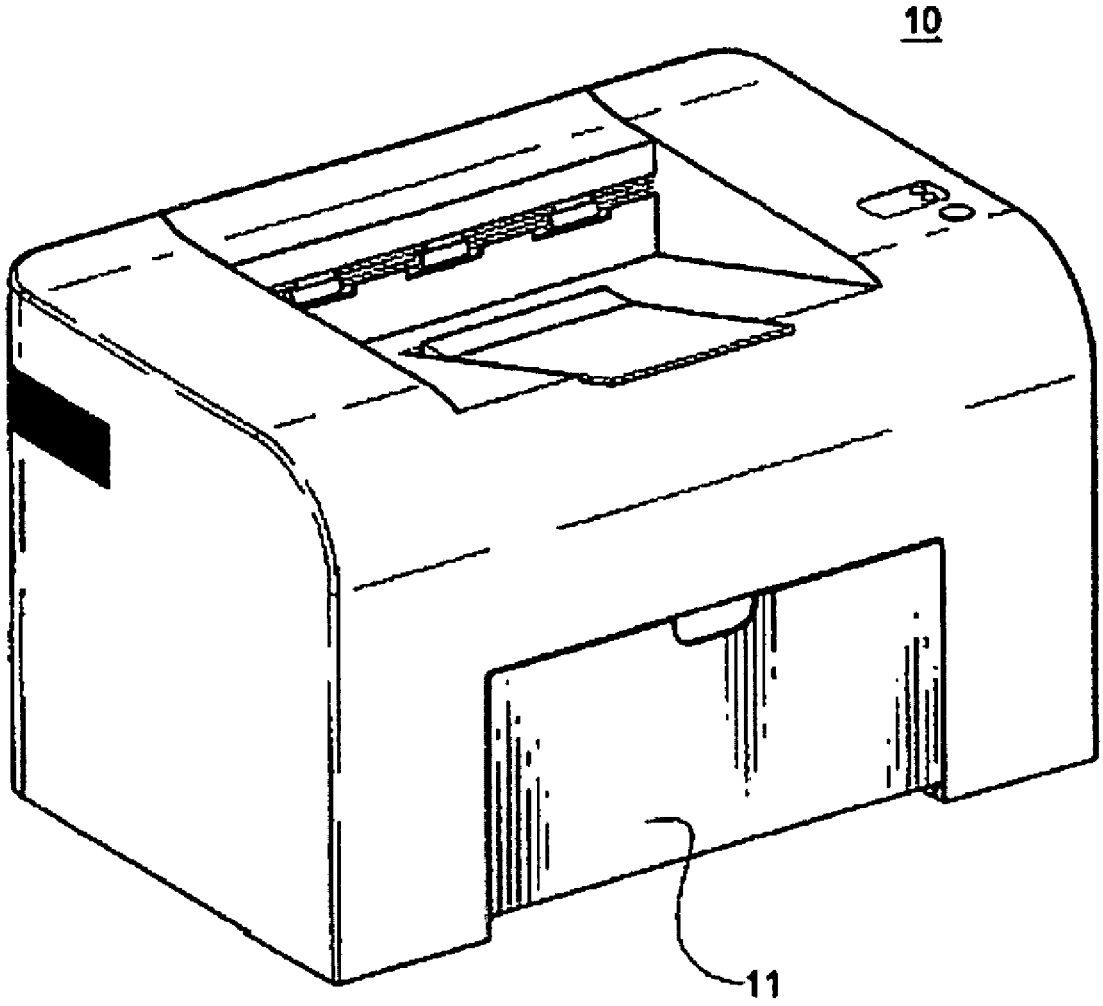
FIG. 1 (PRIOR ART)
FIG. 1 is a perspective view of a conventional image forming apparatus.
Figure 2:
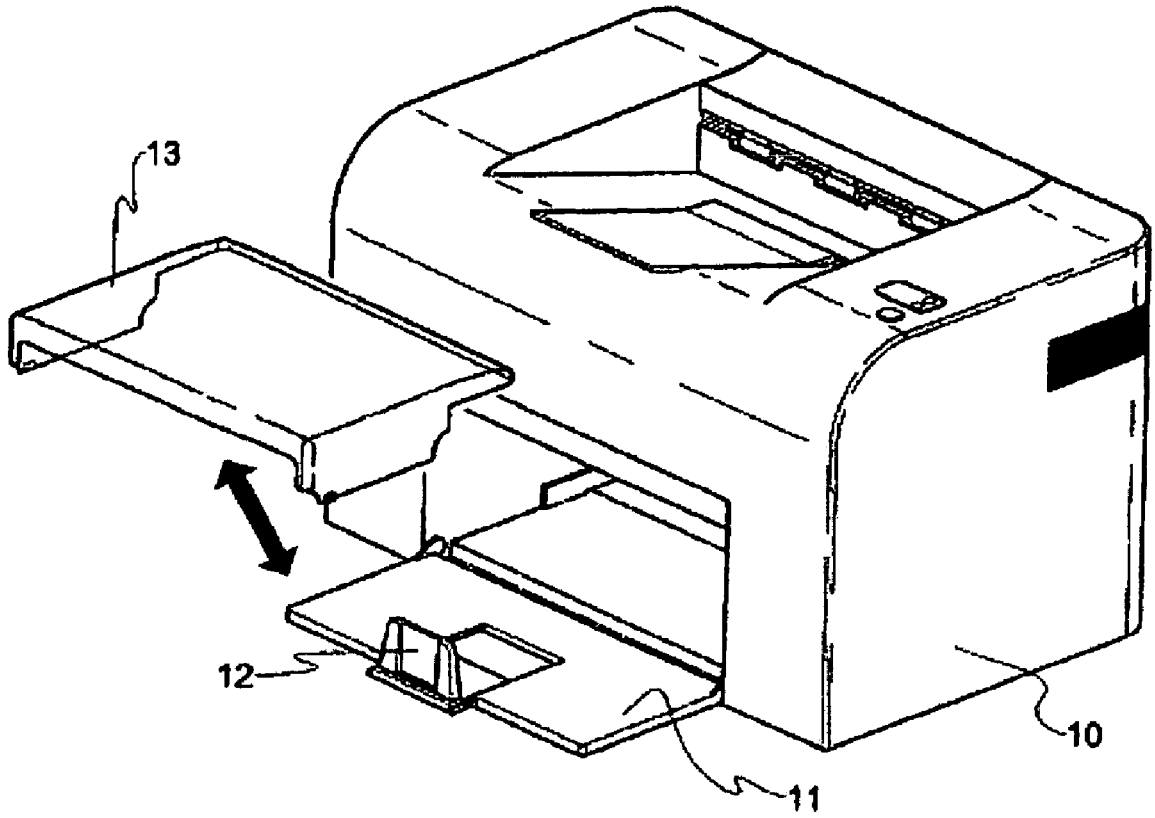
FIG. 2 (PRIOR ART)
FIG. 2 is a perspective view of the image forming apparatus of FIG. 1, with a front cover opened.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
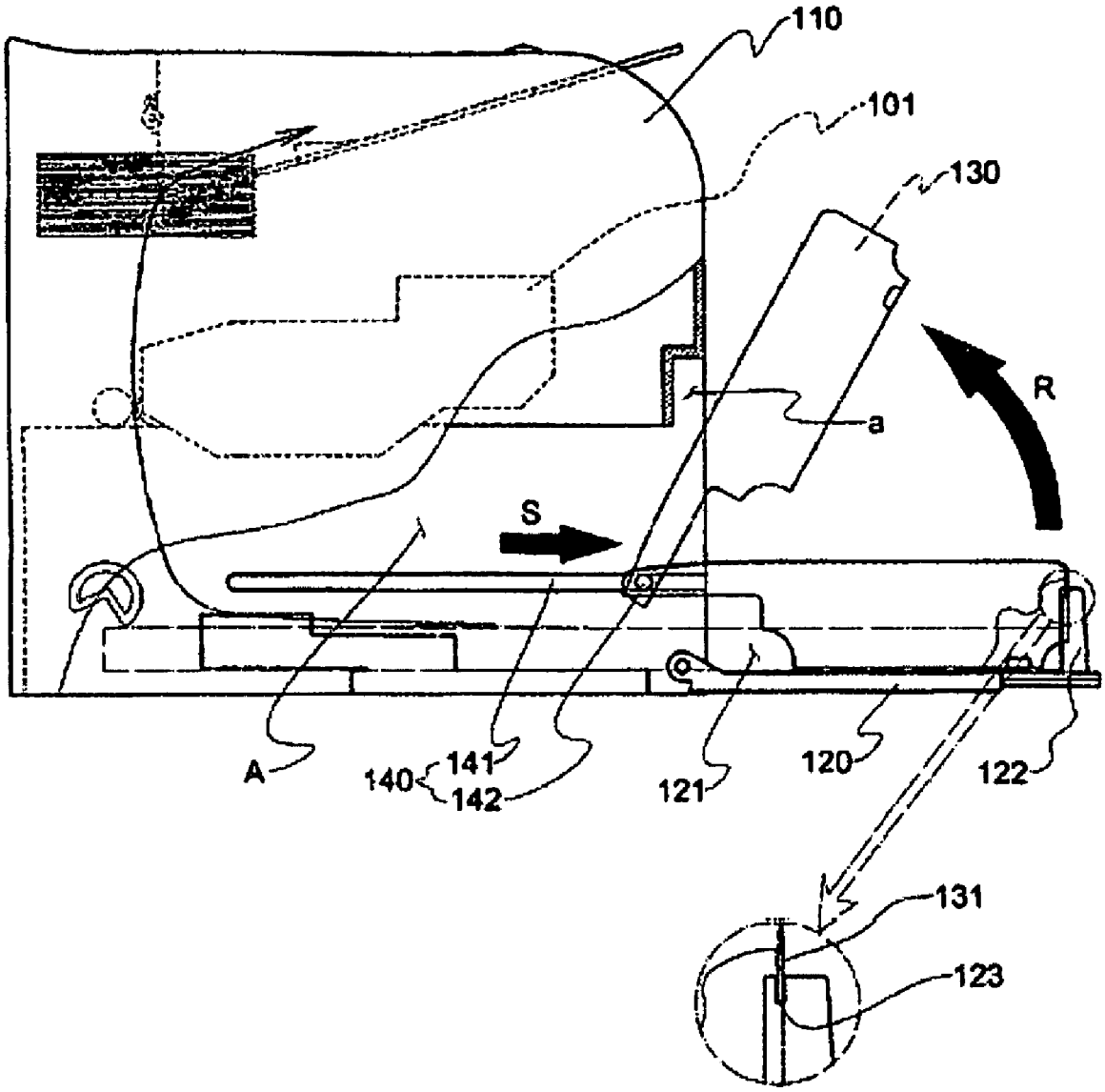
FIG. 3 is a longitudinal sectional view of an image forming apparatus according to an embodiment of the present invention, with a front cover opened.
Figure 4:
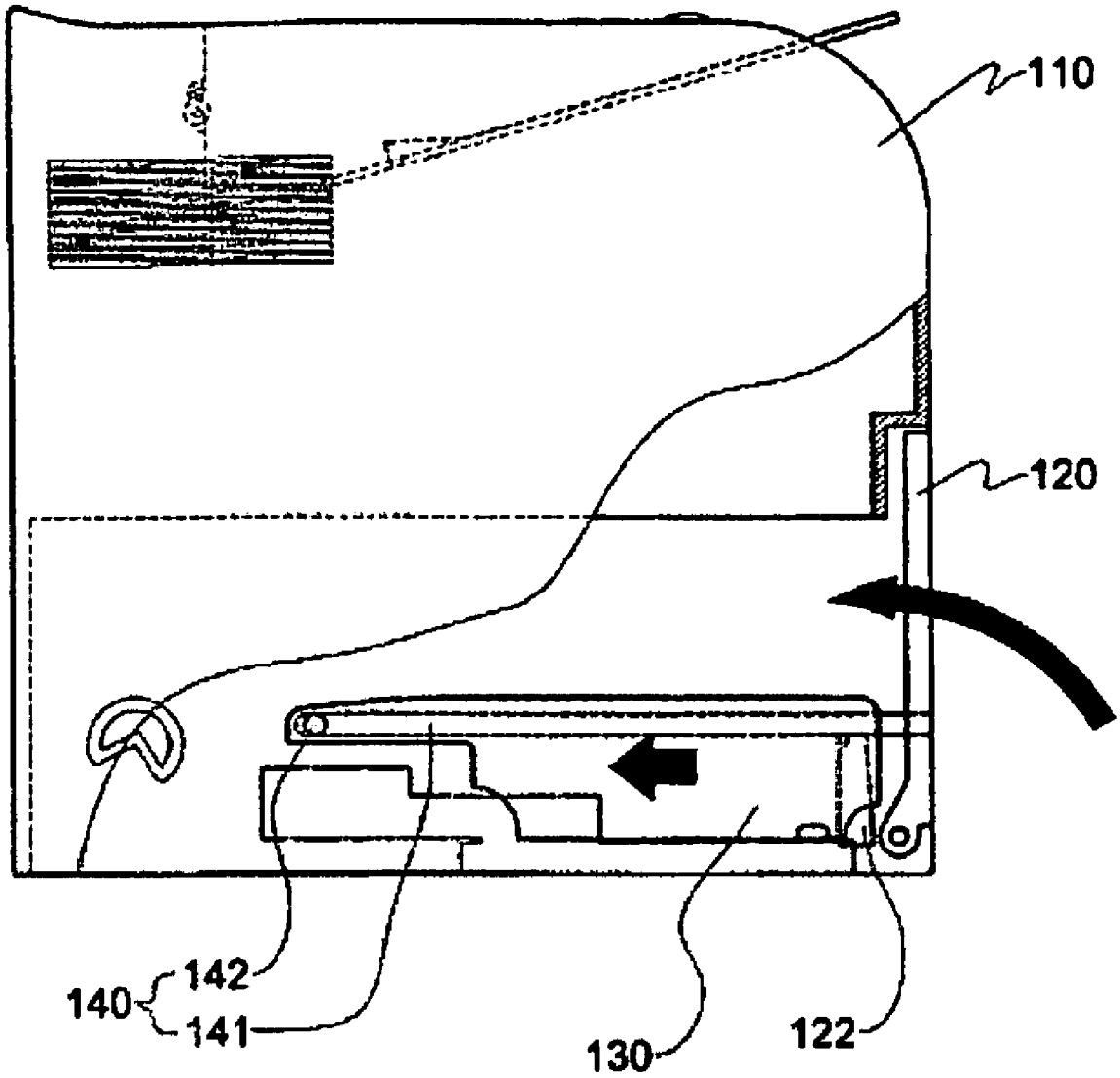
FIG. 4 is a longitudinal sectional view of the image forming apparatus according to an embodiment of the present invention, with a tray cover inserted in a vacant space so as to close the front cover.

FIGS. 3 and 4 are sectional side views showing main elements of an image forming apparatus according to an embodiment of the present invention. With reference to FIGS. 3 and 4, the image forming apparatus, according to an embodiment of the present invention, comprises a main body 110 and a paper supply unit which includes a front cover 120, and a tray cover 130. The main body 110 comprises an engine unit 101 to perform a printing operation and a paper feeding and discharging unit (not shown).

The front cover 120 is mounted to open and close the main body 110 in a pivoting manner at a paper supply port 'a' formed on the front of the main body 110. The front cover 120 is opened forward during a use of the image forming apparatus so as to provide for a paper receiving space 121 in/on which a plurality of paper sheets may be stacked. When the image forming apparatus is not used for a long time, carried or stored, the front cover 120 may be closed so as to define an exterior frame of the image forming apparatus.

As shown in FIG. 3, the paper receiving space 121 is defined by a bottom of the main body 110 and the front cover 120, which, when opened, allows for the stacking of the paper thereon. In order to receive the paper, as stacked, a predetermined vacant space A is provided in the main body 110.

A rear-end guide 122 is slidably mounted to the front cover 120 to arrange rear ends of the stacked paper. The rear-end guide 122 slides along a guide groove 124 (see FIG. 5) formed on the front cover 120. The guide groove 124 is extended up to a bottom of the vacant space A, so that the rear-end guide 122 may be inserted into the vacant space A. The rear-end guide 122 is connected with the tray cover 130, so that the tray cover 130 may enter and exit from the vacant space A as the rear-end guide 122 slides.

Figure 5:
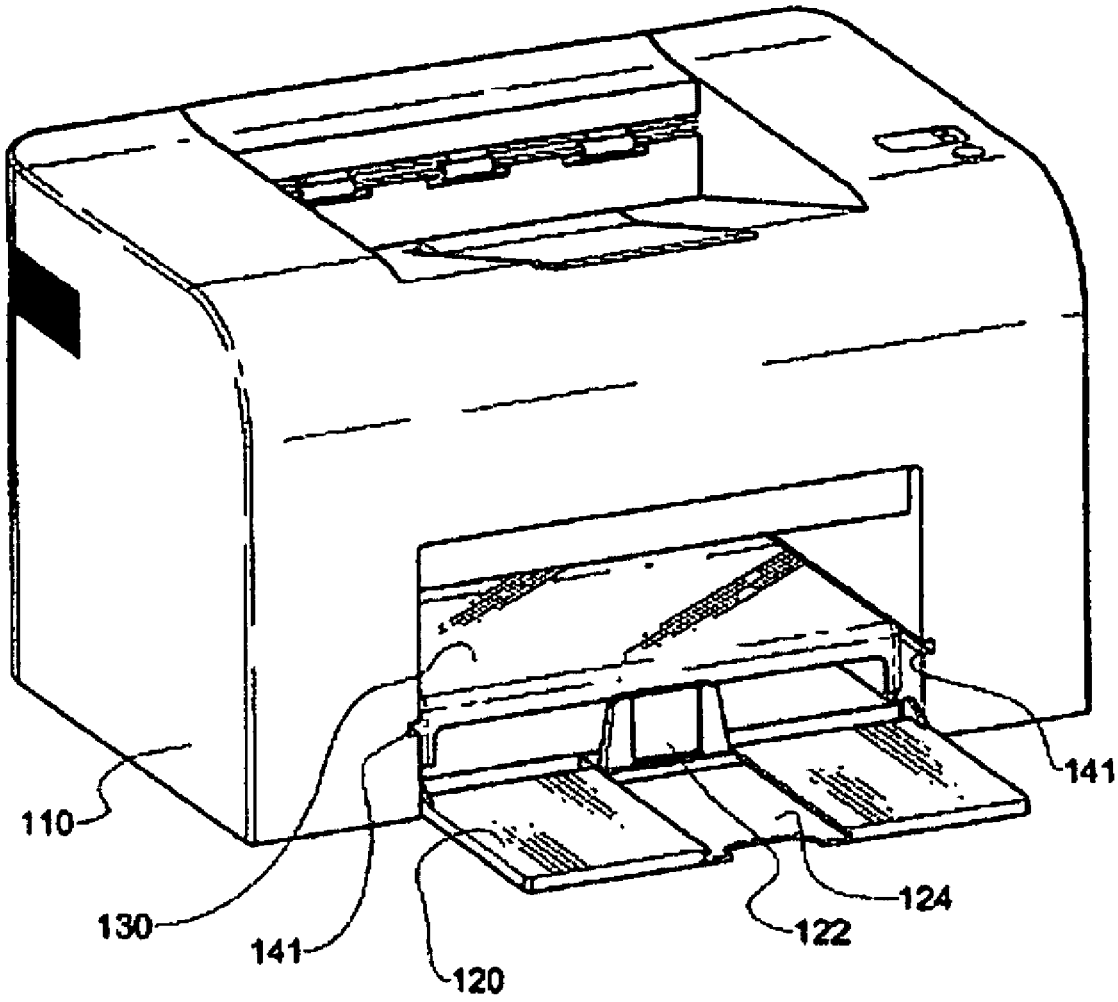
FIG. 5 is a perspective view of the image forming apparatus according to an embodiment of the present invention, with the tray cover inserted into a main body of the image forming apparatus so as to close the front cover.

More specifically, as shown in FIG. 3, a bent end 131 of the tray cover 130 is received in a cover groove 123 formed at an upper part of the rear-end guide 122. Therefore, if a user draws out the rear-end guide 122, the tray cover 130 and the rear-end guide 122 are slid together in a direction shown by arrow S in FIG. 3. In order to insert the tray cover 130 in the main body 110, the user pushes in the rear-end guide 122 such that the rear-end guide 122 and the tray cover 130 are received in the vacant space A of the main body 110 as shown in FIGS. 4 and 5.

The tray cover 130 is mounted so as to be opened and closed with respect to the main body 110 in order to prevent inflow of dust or foreign substances into the paper receiving space 121. The tray cover 130 is received in the vacant space A formed in the main body 110 when the front cover 120 is closed by a sliding unit 140. When the front cover 120 is opened so as to define the paper receiving space 121, the tray cover 130 is moved out from the received position and disposed above the paper receiving space 121 so as to prevent inflow of the dust and foreign substances.

The sliding unit 140 comprises a guide rail 141 and a projection 142. The guide rail 141 is formed in the main body 110 to guide an entrance and an exit of the tray cover 130. As shown in FIGS. 3 and 4, the guide rails 141 are formed on opposite sidewalls in the vacant space A. The projection 142, being inserted in the guide rail 141, slides along the guide rail 141. In an embodiment of the invention, the projection 142 has a substantially circular section as shown in FIGS. 3 and 4, so that the projection 142 operates as a shaft to allow for a pivoting motion of the tray cover 130 such that the tray cover 130 may be opened by a pivot thereof in a direction shown by arrow R in FIG. 3. Therefore, when supplying the paper to the paper receiving space 121, the tray cover 130 is rotated about the projection 142 to be opened.

Hereinbelow, the operation of the image forming apparatus according to an embodiment of the present invention will be described with reference to FIGS. 3 to 5. As shown in the drawings, in the image forming apparatus according to an embodiment of the present invention, by an opening the front cover 120 pivotably formed on the front of the main body 110, the front cover 120 may act as the paper receiving space 121 which stacks a plurality of paper sheets thereon.

More specifically, when the front cover 120 is opened, the user draws out the tray cover 130 which is received in the vacant space A of the main body 110, together with the rear-end guide 122, in the direction shown by arrow S in a sliding manner, so that the tray cover 130 is disposed over the front cover 120 acting as the paper receiving space 121.

In order to fill the paper in the paper receiving space 121, the tray cover 130 is rotated in the direction shown by arrow R of FIG. 3 to release the engagement between the rear-end guide 122 and the tray cover 130. Accordingly, the paper receiving space 121 is opened to receive the paper.

After a use of the image forming apparatus, the rear-end guide 122 and the tray cover 130 are inserted together in the vacant space A formed in the main body 110. By a pushing in the rear-end guide 122, engaged with the tray cover 130, the rear-end guide 122 and the tray cover 130 may be received into the vacant space A at the same time. When the tray cover 130 is thus received in the vacant space A and the front cover 120 is closed, the front cover 120 constitutes a part of the exterior frame of the image forming apparatus.

As is described above, since the tray cover 130 is received in the main body 110 when the image forming apparatus is not used for a long time or is stored, the tray cover 130 would not be easily lost. Also, the user does not have to set up the tray cover 130 when using the image forming apparatus. Therefore, the user does not have to setup the tray cover 130 to prevent dust or foreign substances from flowing into the image forming apparatus. In other words, when the image forming apparatus is in use, the tray cover 130 is slid out together with the rear-end guide 122 to cover the upper part of the paper receiving space 121 where the plurality of paper sheets are stacked, and inflow of dust or foreign substances into the paper receiving space 121 may be prevented.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A paper supply unit for an image forming apparatus, comprising:

a front cover mounted to a main body of the image forming apparatus to occupy and move between open and closed positions, and, when occupying the opened position, defining a paper receiving space in which printing paper is to be stacked;

guide rails defined in opposite sidewalls inside of the main body;

a tray cover disposed to cover the printing paper stacked on the front cover; and projections, formed on opposite sides of the tray cover to be respectively received in the guide rails as the front cover moves between the open and closed positions, about which the tray cover rotates when the front cover occupies the open position.

2. The paper supply unit of claim 1, further comprising a rear-end guide movably mounted to the front cover to arrange a rear end of the paper being stacked.

3. The paper supply unit of claim 2, wherein the rear-end guide and the tray cover are moved together.

4. An image forming apparatus comprising:

a main body including a print engine part and a paper supply port;

a front cover mounted to the main body of the image forming apparatus to occupy and move between open and closed positions, and, when occupying the opened position, defining a paper receiving space in which printing paper is to be stacked;

guide rails defined in opposite sidewalls inside of the main body;

a tray cover disposed to cover the printing paper stacked on the front cover; and projections, formed on opposite sides of the tray cover to be respectively received in the guide rails as the front cover moves between the open and closed positions, about which the tray cover rotates when the front cover occupies the open position.

5. The image forming apparatus of claim 4, further comprising a rear-end guide movably mounted to the front cover to arrange a rear end of the paper being stacked.

6. The image forming apparatus of claim 5, wherein the rear-end guide and the tray cover are moved together.

7. A paper supply unit of an image forming apparatus having a main body to define a vacant space, comprising:

a front cover mounted to the main body to occupy and move between a closed position in which the front cover prevents an inflow of dust and particles into the vacant space and an open position in which the front cover defines a paper receiving space in which printing paper is to be stacked;

guide rails defined in opposite sidewalls inside of the main body;

a tray cover disposed to cover the printing paper stacked on the front cover; and projections, formed on opposite sides of the tray cover to be respectively received in the guide rails as the front cover moves between the open and closed positions, about which the tray cover rotates when the front cover occupies the open position.

8. The paper supply unit according to claim 7, further comprising a rear-end guide movably mounted to the front cover to arrange a rear end of the paper being stacked.

9. The paper supply unit according to claim 8, wherein the rear-end guide and the tray cover are moved together.

10. The paper supply unit according claim 7, further comprising a paper supply port formed on the main body, wherein the front cover opens the paper supply port in the open position and closes the paper supply port in the closed position.

11. The paper supply unit according to claim 7, wherein the paper receiving space is defined by a bottom of the main body and the front cover.

12. The paper supply unit according to claim 7, wherein the vacant space receives the stacked paper as the stacked paper is fed into the main body.

13. The paper supply unit according to claim 7, further comprising:

a rear-end guide to be slidably mounted to the front cover to arrange rear ends of individual sheets of the stacked paper with respect to each other; and a guide groove, formed on the front cover to extend to a bottom of the vacant space, in which the rear-end guide slides from an end of the front cover to a portion of the vacant space.

14. The paper supply unit according to claim 13, wherein the tray cover comprises a bent end and the rear-end guide comprises a cover groove at an upper end thereof, the bent end of the tray cover being received in the cover groove such that the tray cover and the rear-end guide may be slid together.

15. The paper supply unit according to claim 7, further comprising a sliding unit along which the tray cover slides so as to be received in the vacant space.

16. An image forming apparatus comprising:

a main body including a print engine part and a paper supply port to define a vacant space therein;

a front cover mounted to the main body to occupy and move between a closed position in which the front cover prevents an inflow of dust and particles into the vacant space and an open position in which the front cover defines a paper receiving space in which printing paper is to be stacked;

guide rails defined in opposite sidewalls inside of the main body;

a tray cover disposed to cover the printing paper stacked on the front cover; and projections, formed on opposite sides of the tray cover to be respectively received in the guide rails as the front cover moves between the open and closed positions, about which the tray cover rotates when the front cover occupies the open position.

* * * * *